United States Patent [19]

Paganon et al.

[11] Patent Number: 4,793,313

[45] Date of Patent: Dec. 27, 1988

[54] FUEL INJECTION APPARATUS FOR INTERNAL COMBUSTION ENGINES

[75] Inventors: Henri Paganon, Venissieux; Werner Pape, Jonage, both of France; Néstor Rodriguez-Amaya, Stuttgart; Alfred Schmitt, Ditzingen, both of Fed. Rep. of Germany

[73] Assignee: Robert Bosch GmbH, Stuttgart, Fed. Rep. of Germany

[21] Appl. No.: 24,196

[22] Filed: Mar. 10, 1987

[30] Foreign Application Priority Data

Apr. 10, 1986 [DE] Fed. Rep. of Germany ..... 3612152
Sep. 30, 1986 [DE] Fed. Rep. of Germany ..... 3633107

[51] Int. Cl.[4] ..... F02M 39/00

[52] U.S. Cl. ..... 123/506; 73/119 A; 123/494

[58] Field of Search ..... 123/506, 458, 494, 500, 123/501, 357–359, 449; 73/119 A

[56] References Cited

U.S. PATENT DOCUMENTS

| | | | |
|---|---|---|---|
| 3,244,663 | 10/1967 | Dreisin | 73/119 A |
| 3,779,225 | 12/1973 | Watson . | |
| 4,359,994 | 11/1982 | Hofer et al. . | |
| 4,494,507 | 11/1985 | Yasuhara | 73/119 A |
| 4,523,569 | 6/1985 | Seilly | 123/506 |
| 4,546,749 | 10/1985 | Igashira | 123/506 |
| 4,571,992 | 2/1986 | Kuhn | 73/119 A |
| 4,653,455 | 3/1987 | Eblen | 123/506 |
| 4,655,184 | 2/1987 | Eckert | 123/506 |
| 4,667,633 | 5/1987 | Stumpd | 73/119 A |

FOREIGN PATENT DOCUMENTS

| | | | |
|---|---|---|---|
| 3302292 | 7/1984 | Fed. Rep. of Germany | 123/494 |
| 2295247 | 7/1976 | France | 123/494 |
| 0176358 | 10/1932 | Japan | 73/119 A |
| 0027882 | 2/1983 | Japan | 123/458 |
| 2069599 | 8/1981 | United Kingdom | 123/494 |
| 2158612 | 11/1985 | United Kingdom | 123/506 |

*Primary Examiner*—Carl Stuart Miller
*Attorney, Agent, or Firm*—Edwin E. Greigg

[57] ABSTRACT

A fuel injection apparatus for internal combustion engines in which via an electrically controlled valve communication is established between a pump work chamber of a fuel injection pump and a low-pressure fuel chamber, and the switching times and movement times of the valve member of the valve are detected with the aid of a switching position transducer. The actual switching times are used for correction of the control times of the valve and thus for correction of the quantity of fuel attaining injection.

24 Claims, 6 Drawing Sheets

FUEL INJECTION APPARATUS FOR INTERNAL COMBUSTION ENGINES

BACKGROUND OF THE INVENTION

The invention is directed to improvements in fuel injection systems of the distributor injection pump type for internal combustion engines.

The electrically controlled valves used in a known fuel injection apparatus for this type, which are usually electromagnetic valves, have substantially constant switching times that are determined by the valve construction. For accurate metering of the fuel injection quantity, the rpm and under some conditions the instant of injection as well must be taken into account when the opening and closing instants of the valves are set. This is done in view of the fact that as a rule the switching speed, that is, the time required for the opening or closing of the valves, is constant, so that during the phase of calculating the fuel injection quantity the two switching events affect the accuracy of the calculation, because the varying rpm. Attempts have therefore been made to use valves having the shortest possible switching time, so that the rpm error does not affect the calculation of the fuel injection quantity, or affects it only to a negligible extent.

The metering of the fuel injection quantity is also affected by variations from one valve to another in the valve type used. For example, the switching time of the valve can change over the service life of the valve, because of how the valve is constructed; over a long-term, drift can develop again negatively affecting the metering of the fuel injection quantity. Finally, such valves can also operate incorrectly, for example with sticking or seizing of the valve member, which depending on the situation may result in the destruction of the engine unless other safety precautions are taken. Such safety precautions are technologically possible but very expensive to use.

Injection nozzles used in connection with a fuel injection apparatus of the above generic type are also known in which the valve needle is electrically insulated with respect to its guide bore or the housing carrying it, is connected to a source of measuring voltage, and in its closing position has conductive contact via the valve seat with the electrically conductive housing of the injection valve, or with ground, which is connected to the other pole of the measuring voltage source.

With an injection nozzle equipped in this way, the injection onset is detected upon the opening of the injection nozzle, and via the injection nozzle a previously specified fuel injection quantity attains injection. The delivery of this fuel injection quantity is effected by the opening of the injection nozzle and keeps the nozzle needle in the open position for as long as the required injection pressure is maintained via the continuous delivery of fuel. The closure of the nozzle needle is effected by terminating the fuel delivery.

OBJECT AND SUMMARY OF THE INVENTION

It is a principal object of the fuel injection apparatus according to the invention that the fuel that the fuel injection quantity metered via the electrically controlled valve can be detected very accurately, more accurately than heretofore. The actual switching times of the valve, those times being the instants when a switching state (that is, the closing or opening state) different from the previous state is attained, are ascertained highly accurately, so that the duration of the valve switching position that is operative for metering is detected exactly.

It is another object of the invention to provide that the opening event and the closing event of the valve, or one of the two, can be additionally ascertained as well, and further via a respective empirically ascertained factor the timing of the event(s) can be added to the effective metering control time for the quantity of fuel actually attaining injection. As a result, still more accurate detection of the period of time relevant for calculating the fuel injection quantity is possible, so that the control unit can correct the switching instants of the valve continuously. This timing recognition plays a substantial role particularly when a magnetic valve is used; in such a valve the closing phase, when the excitation of the magnet is switched off, greatly affects the effective control time of the magnetic valve.

It is yet another object of the invention that the electrically controlled valve in the fuel injection apparatus according to the invention can be used both as a metering valve, with which during the intake phase of the pump piston the quantity of fuel attaining injection during the ensuing pumping stroke of the pump piston is metered to the pump work chamber from the low-pressure fuel chamber, and as an injection duration control valve or shutoff valve, in which no injection pressure can build up in the pump work chamber as long as the valve is open.

Still another object of the invention is to provide improvements in the switch position transducer. All of these switch transducers of the invention are distinguished by the simplicity with which they can be installed in the fuel injection pump and by being predominantly wear-free. Coupling of additional masses to the valve member or valve needle, which are deleterious for the switching times of the valve, is avoided. The electromagnetic switching events cannot cause an inaccurate electrical signal of the switch position transducer.

The invention will be better understood and further objects and advantages thereof will become more apparent from the ensuring detailed description of preferred embodiments taken in conjunction with the drawings.

DESCRIPTION OF THE PREFERRED EMBODIMENTS

Figure 1:
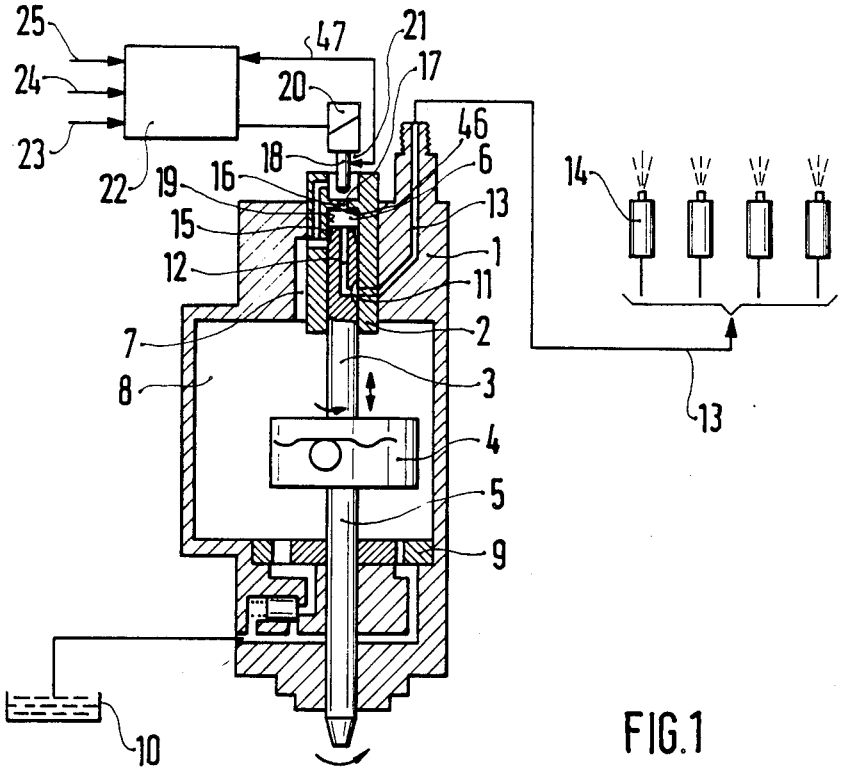
FIG. 1 shows a fuel injection apparatus having a fuel injection distributor pump, shown in longitudinal section, and a 2/2-way magnetic valve used as a shutoff valve.

In the distributor-type fuel injection pump shown in longitudinal section in FIG. 1 as an example of a fuel injection pump, a pump piston 3 executes a simultaneously reciprocating and rotary motion, in a known manner, in the cylinder bore 19 of a bushing 2 disposed in a housing 1. The pump piston 3 is driven by a cam drive 4 via a shaft 5, which rotates in synchronism with the rpm of the internal combustion engine to which fuel is supplied by the fuel injection pump. The bushing 2 and the end face of the pump piston 3 define a pump work chamber 6, which communicates via a supply conduit 7 with a low-pressure fuel chamber or suction chamber 8 in the housing 1 of the fuel injection pump. The suction chamber 8 is supplied with fuel from a fuel supply container 10 via a feed pump 9. From the pump work chamber 6, via a distributor opening 11 that discharges at the circumference of the pump piston 3 inside the bushing 2 and that is in continuous communication with the pump work chamber 6 via a pressure conduit 12 extending longitudinally in the pump piston 3, the fuel is distributed to pressure lines 13 in accordance with the rotation of the pump piston 3. The pressure lines 13 lead via the bushing 2 and the housing 1 to injection nozzles 14 of the engine. The number of pressure lines 13 supplied by the distributor opening 11 corresponds to the number of engine injection nozzles 14 that are to be supplied. The pressure line 13 are distributed in a radial plane about the pump piston 13 in accordance with the supply frequency. Instead of the distributor fuel injection pump shown, a known in-line injection pump or unit fuel injector could be used.

In the end region of the pump piston 3 remote from the pump work chamber 6, longitudinal grooves 15 are provided on the pump piston 3 which are open toward the end face and hence toward the pump work chamber 6 and by way of which, during the intake stroke of the pump piston, communication is established between the supply conduit 7 and the pump work chamber 6. A connecting line 16 that leads to the supply conduit 7 branches off from the pump work chamber 6, at a point that cannot be affected by the pump piston 3. The connecting line 16 may, however, also be extended directly to the intake side of the pump piston 3 or directly to the suction chamber 8. The connecting line 16 is defined at the end of a flow opening 46, which is surrounded by a valve seat 17. Cooperating with the valve seat 17 is a valve member 18 of an electrically controlled valve 20, which in the exemplary embodiments is embodied as a 2/2-way magnetic valve. Depending on the switching position of the valve 20, the flow opening 46 is uncovered or blocked, and accordingly the connecting line 16 to the supply conduit 7 and hence to the suction chamber 8 is opened or closed.

Associated with the valve member 18 of the valve 20 is a switching position transducer 21, which detects the instantaneous switching position of the valve 20 and delivers and electrical signal 47 accordingly to an electronic control unit 22. This control unit switches in accordance with inputs representing various engine operating characteristics, such as load 23, rpm 24, and temperature 25 and feedback via the electrical signals 47 of the valve 20 from the switching position transducer 21, all of which factors characterize the actual switching position of the valve 20 and hence its switching instant.

Figure 2:
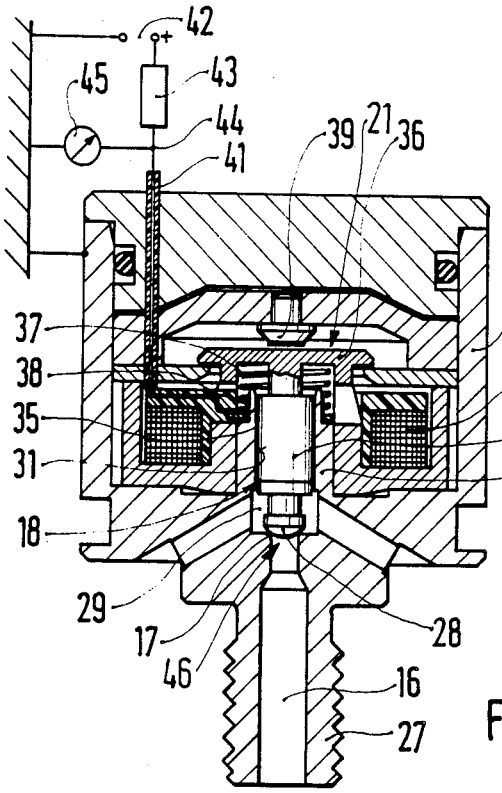
FIG. 2 is a longitudinal section taken through the 2/2-way valve of FIG. 1, shown on a larger scale.

The electrically controlled valve 20 in the form of a 2/2-way magnetic valve is shown in longitudinal section and on a larger scale in FIG. 2. The valve 20 can be screwed with its valve housing 40 into the housing 2 and thus at the same time defines the pump work chamber 6. Through a threaded portion 27 integral with the valve housing 40 and serving to connect same to the housing 1 of the fuel injection pump, the connecting line 16 then extends as far as the valve seat 17 surrounding the flow opening 46, and from there extends downstream via a valve chamber 29 and further sections of the connecting line 16 to the supply conduit 7 (not shown). Cooperating with the valve seat 17 is a spherical formed or mushroom-shaped section 28 of the valve member 18, which is guided with a cylindrical section 30 in a guide bore 31. The guide bore 31 is located inside a central core 33 that is integral with the valve housing 40 and surrounded by a magnet coil 34. In the vicinity of the guide bore 31, the cylindrical section 30 of the valve member 18 is electrically insulated from the guide bore 31, which can be achieved by means of a suitable coating 35. On the end remote from the spherically-shaped or mushroom-shaped section 28 of the valve member 18, the valve member 18 is connected to an armature plate 36. A compression spring 37 acting in the valve opening direction is fastened in place between the armature plate 36 and the core 33, causing the armature plate 36, when the magnet coil 34 is not excited, to rest on a stop 39 to limit the stroke of the valve member 18. The stop 39 is secured in the metal valve housing 40 and is electrically conductively connected to it, while the compression spring 37 is electrically insulated from the core 33 or from the valve housing 40 by an insulation layer 38. When the magnet coil 34 has no electric current running through it, the valve member 18 accordingly is in electrical contact with the housing 40, via the armature plate 36 and the stop 39. When there is electric current in the magnet coil 34, the valve member 18 is in the closing position shown in FIG. 2 and is then in electrical contact with the housing 40 via the mushroom-shaped section 28 and the valve seat 17.

An electrically insulated supply lead 41 is also provided, which is guided in an insulated manner all the way through the housing 40 as far as the compression spring 37, where electrical contact is made between the electric supply lead 41 and the compression spring 37, and via which spring there is thus electrical contact made with the armature plate 36 and the valve member 18. The supply lead 41 is connected to one pole of a voltage measuring source 42, with an interposed resistor 43. The other pole of the voltage measuring source 42 is connected to the housing 40. Between the connection point 44 of the supply lead 41 and resistor 43 and the housing 40, a measuring voltage is picked up, which becomes the characteristic representative of the instantaneous position of the valve member 18. The voltage pickup is symbolized by the measuring instrument 45 shown in FIG. 2.

Figure 3:
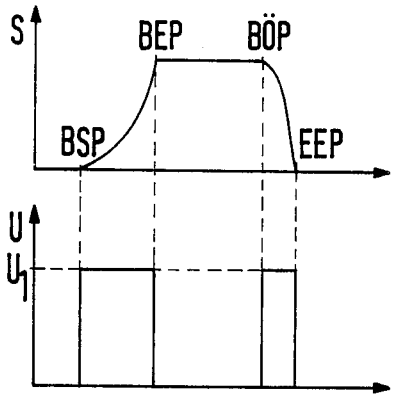
FIG. 3 is a diagram of the magnetic valve stroke and a diagram of the output signal of a switch position transducer in the 2/2-way magnetic valve of FIG. 1, in each case plotted as a function of time.

In FIG. 3, the upper diagram shows the stroke S or adjustment path of the valve member 18 plotted as a function of time. In the lower diagram of FIG. 3, the control voltage at the connection point 44, as measured by the measuring instrument 45, is shown, which forms the output signal 47 of the switching position transducer 21 of FIG. 1. Initially, with the magnet coil 34 lacking current, the valve member 18 is in the open position. The armature plate 36 rests on the stop 39, so that the ground connection of the electric supply lead 41 is established and the voltage collapses at the connecting point 44. At point BSP (beginning of the closing period) after an initial switching-on time lag, measured from the time of application of a current pulse to the magnet coil 34, the armature plate 36 lifts from the stop 39. At this instant, the connection to ground is broken, and the voltage picked up at the connecting point 44 rises to a value U1 (see lower diagram of FIG. 3). The stroke of the valve member 18 is ended at point BEP (beginning of the injection period) which coincides with the time of occurrence of the closing event of the valve. Section 28 of the valve member 18 now rests on the valve seat 17, so that the contact with ground is reestablished and the measuring voltage source 42 is again short-circuited. The voltage picked up with the measuring instrument 45 collapses again. In the ensuing period of time, the fuel injection takes place. In some circumstances injection may already have begun in the period BSP-BEP after a predetermined pressure level was attained.

In response to a control signal of the control unit 22, the excitation of the magnet coil 34 is switched off. After a switching-off time lag, during which residual forces of the magnetic circuit still keep the valve member in the closing position, the point BÖOP (beginning of the opening period) is reached. At this stage the valve member 18 begins to lift from the valve seat 17 under the influence of the compression spring 37. At this instant, the voltage picked up at the connecting point 44 again rises to the value U1 and does not collapse again until the armature plate 36 connected to the valve member 18 has reached the stop 39. This time coincides with the point EEP (end of the injection period). By means of the switching position transducer 21, very exact signals are therefore obtained, regardless of the control time of the current-supply pulse of the magnet coil 34, for the actual movement of the valve member 18 out of its two terminal positions, that is, its closing and opening positions.

For known reasons, as the magnetic field in the magnet coil 34 builds up and fades in the magnet coil 34 over variant courses, thus causing different rise and fall curves to develop between BSP and BEP, on the one hand, and BÖP and EEP, on the other. The influence of the latter, voltage fading course on the injection quantity is greater, because of the high pressure prevailing in the pressure chamber, and so it has more effect on the metering of the fuel injection quantity, which is why the final point EEP is also called the end of fuel injection. Via the control unit 22, this fading voltage period can now be corrected and compensated for by a factor that is associated with the effective injection period for the metering of the fuel injection quantity. In addition to the period BEP-BÖP, a portion of the period BSP-BEP can also be taken into account by multiplication by a factor. This latter phase is called the first movement phase, which is weighted with a first factor, while the phase mentioned earlier, that is, the phase between BÖ/P and EEP, is called the second movement phase and is weighted with a second, higher factor. Both movement phases therefore enter proportionally into the opening time of the valve 20 that is effective for the metering of the fuel injection quantity.

Based on the signals 47 furnished by the switching position transducer 21, the control unit 22 can now detect the precise opening and closing course of the valve 20 and use this for calculating the actually metered fuel injection quantity. In this process, variations from model to model and deviations in tolerance, as well as drifting and malfunctioning of the valve 20 can be taken into account, because it is always the exact instant of valve closure or valve opening that is detected. If the valve member 18 becomes stuck in any position along the course of the stroke, this can also be recognized. For example, it can be determined whether or not the functional capacity of the valve 20 is impaired from the sequence over time of the arriving movement onset signals and end-of-movement signals, preferably by comparing these signals with the sequence over time of the control pulse edges that trigger the valve. In this way a signal indicating function or nonfunction is generated. The signals emitted by the above-described switching position transducer 21 can be picked up unequivocally. The switching position transducer 21 is made up of simple switch elements. The stop 39 for the armature plate 36 may be of steel, but conductive plastic can also be used. Instead of using the valve member 18 as the electric switching member, separate switches that are connected to the valve member 18 can also be used.

If the valve 20 is used as a so-called metering valve, it is disposed in the supply conduit 7, which then replaces the connecting line 16. In that case, a reverse switching logic is used. The course of the stroke of the valve member 18 would then be the same as that shown in the upper diagram of FIG. 3, except that the valve would be closed at BSP and open at BÖP and closed again at EEP. Accordingly, these points then describe the fuel metering phase, in which the pump work chamber 6 is filled with the metered fuel quantity. To attain these switch functions, either the magnetic coil 34 is exicted accordingly with different control times, or the compression spring 37 is made to act in a different direction. The fuel injection pump can advantageously also be realized in the form of a radial piston pump.

Figure 4:
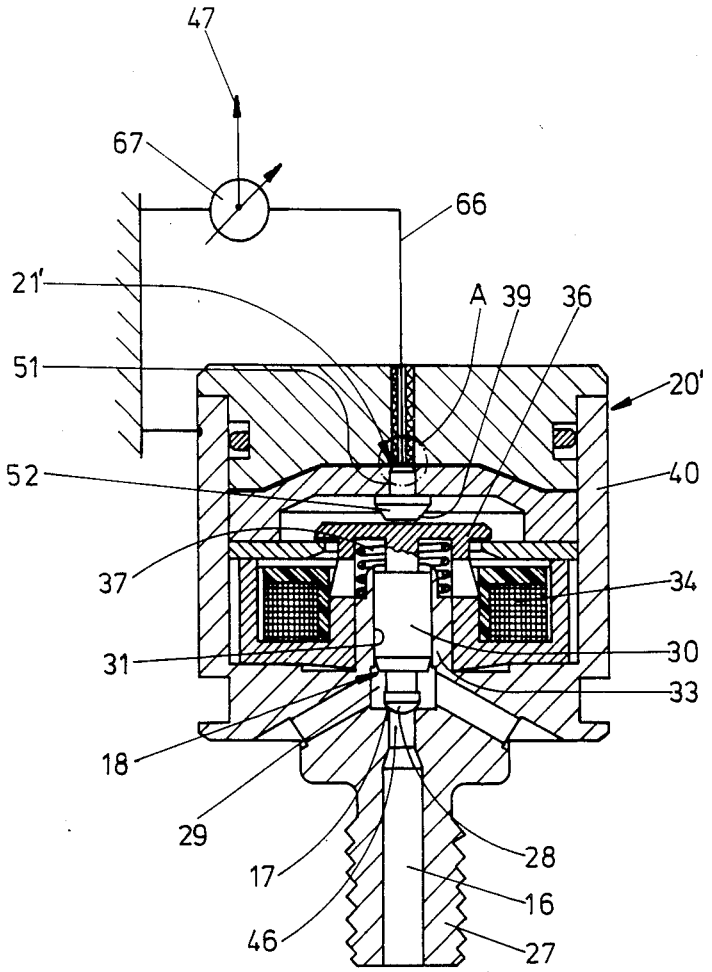
FIG. 4 is a longitudinal section through a 2/2-way magnetic valve of the fuel injection apparatus of FIG. 1, in a further exemplary embodiment and shown on a larger scale.

The further exemplary embodiment of the valve 20 of FIG. 1 that is shown in longitudinal section in FIG. 4 differs from the valve 20 of FIG. 2 only in that the switch position transducer 21' is embodied differently. The structure of the valve 20' of FIG. 4 is identical to the valve 20 described in connection with FIG. 2, except for the omission of the insulation coatings 35 and 38 and for a different kind of terminal of the supply lead 41, so identical components are identified by the same reference numerals.

Figure 5:
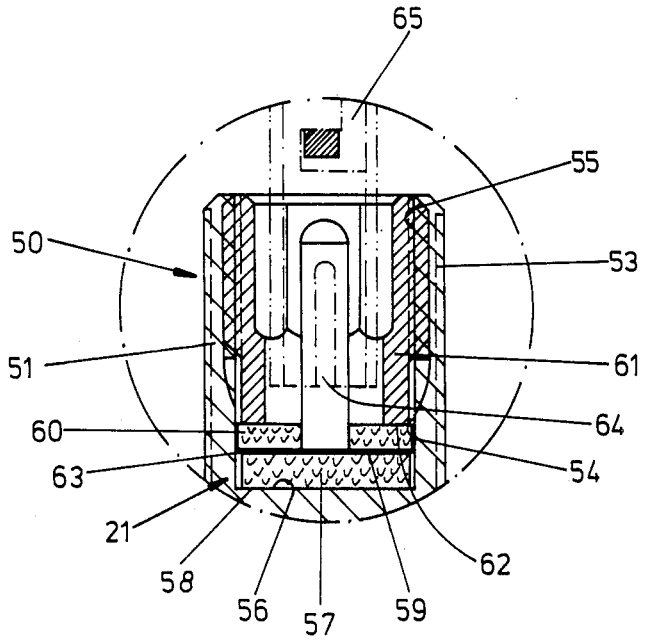
FIG. 5 is an enlarged illustration of the detail marked A in FIG. 4.

The switching position transducer 21' of FIG. 4, shown in more detail in FIG. 5, is secured to the stop 39 for limiting the stroke of the valve member 18. Referring to FIG. 5, the stop 39 is embodied in the form of a bolt 50, which by means of an outer thread 53 is screwed with its shank 51 into the valve housing 40 and with its head 52 (see FIG. 4) is oriented toward the armature plate 36, which is rigidly connected to the valve member 18. The shank 51 has a blind bore 54, with an internal thread 55, extending axially from the end of the shank. A piezoelectric ceramic disc 57, hereinafter called the piezo disc 57, of the switching position transducer 21' is disposed at the bore bottom 56. The piezo disc 57 has a metallized electrode 58, 59 applied to each of its two end faces. The piezo disc 57 rests with one electrode 58 on the bore bottom 56, thereby establishing electrical contact, and is braced on the bore bottom 56 via a pressing ring 60 of insulating material that rests on the other electrode 59. The bracing is effected via a hollow-cylindrical locking screw 61, which is screwed into the internal thread 55 and presses with its annular end face 62 on the pressing ring 60. Between the end face of the pressing ring 60 and the electrode 59 facing it there is a disc-like contact ring 63, which is mechanically and electrically connected to a plug contact 64. The plug contact 64 passes through the annular opening of the pressing ring 60 and extends axially within the interior of the locking screw 61. The contact ring 63, the plug contact 64 and the pressing ring 60 comprise a structural unit. Mounted on the plug contact 64 is a plug 65, shown in dot-dash lines in FIG. 5, which is electrically conductively connected to a supply lead 66 that is passed through the valve housing 40 in an insulated manner. The supply lead is connected to one connection of a terminal of a voltage measuring instrument 67, the other terminal of which rests on the valve housing 40. Alternatively, the piezo disc 57 of the switching position transducer 21' can be disposed directly in the head 52 of the bolt 50, instead of near the free end of the shaft 51 of the bolt 50.

When the valve member 18 meets the valve seat 17 on the one side and the stop 39 on the other, in response to the application or interruption of current to the magnet coil 34, structure-borne sound waves are induced, which result in mechanical strain on the piezo disc 57. This strain on the piezo disc 57 causes electrical charges to form on its electrodes 58, 59. These electrical charges are delivered to the voltage measuring instrument 67 via the plug contact 64 and the plug 65 and after amplification are sent as the signal 47 to the control unit 22.

Figure 6:
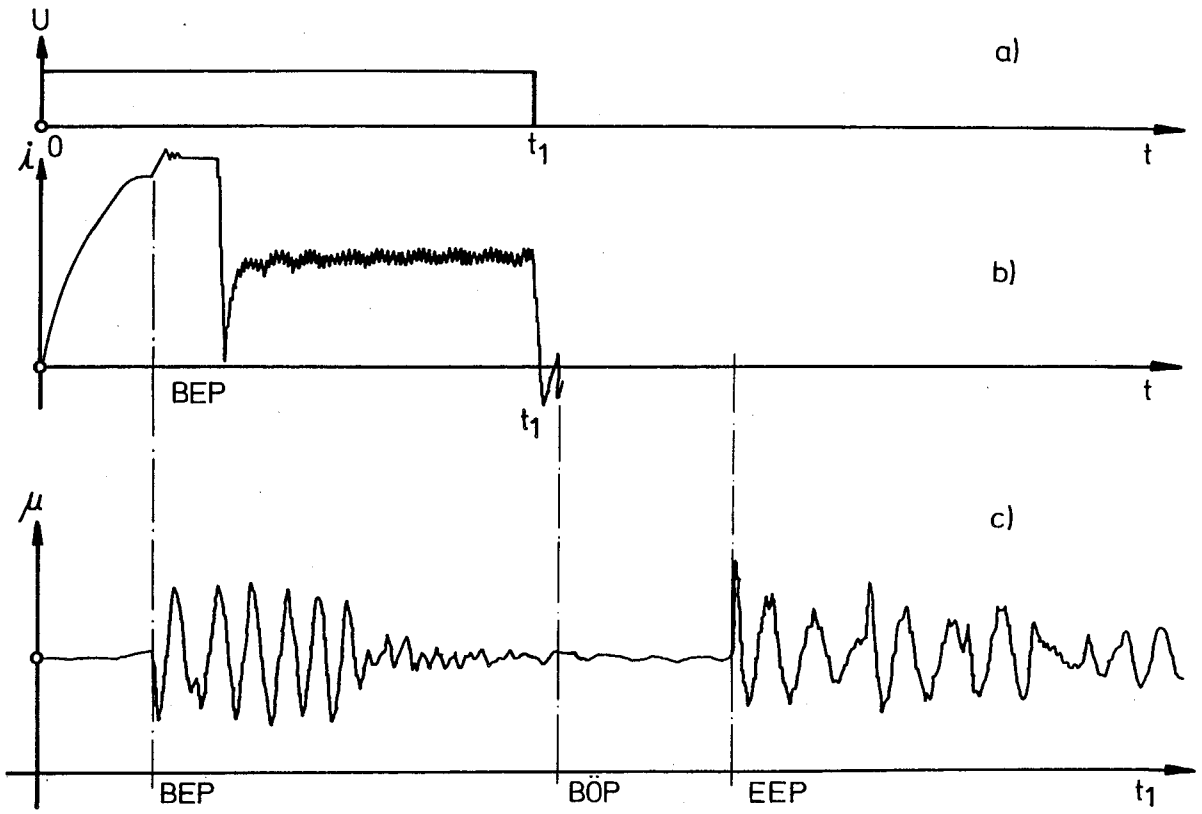
FIG. 6 includes three timing diagrams, respectively showing the course of (a) the exciter voltage of the 2/2-way magnetic valve, (b) the magnet exciter current, and (c) the output signal of the switch position transducer in the 2/2-way magnetic valve of FIG. 4.

In FIG. 6, the operation of the switching position transducer 21' is explained in three diagrams. Diagram a shows the course of the voltage of the control pulse applied to the magnet coil 34 for valve control; diagram b shows the course of the exciter current of the magnet coil 34; and diagram c shows the voltage course detected, after amplification, by the voltage measuring instrument 67, as the output signal of the switching position transducer. At time $t=0$, the magnet coil 34 is triggered, by means of the control pulse. At point BEP, the valve member 18 strikes the valve seat 17. The structure-borne sound wave causes a change in the output signal of the switching position transducer 21', which is clearly recognizable at time BEP in diagram c of FIG. 6. At time $t=t_1$, the magnet excitation is switched off. After a switching-off time lag, the point BÖP is reached. The valve member 18 begins to open and at time EEP strikes the stop 39. The impact of the armature plate 36, which is connected to the valve member 18, against the stop 39 again triggers a structure-borne sound wave, which again mechanically strains the piezo disc 57 and thereby causes a change in the output signal of the switching position transducer 21'. The signal change at time EEP is clearly recognizable in diagram c of FIG. 6. With the aid of the voltage signal emitted by the voltage measuring instrument 67 (diagram c in FIG. 6), the control unit 22 of the fuel injection apparatus can now detect the precise opening and closing course of the valve 20', in the same manner as described above, and use it for calculating the actually metered fuel injection quantity.

Figure 7:
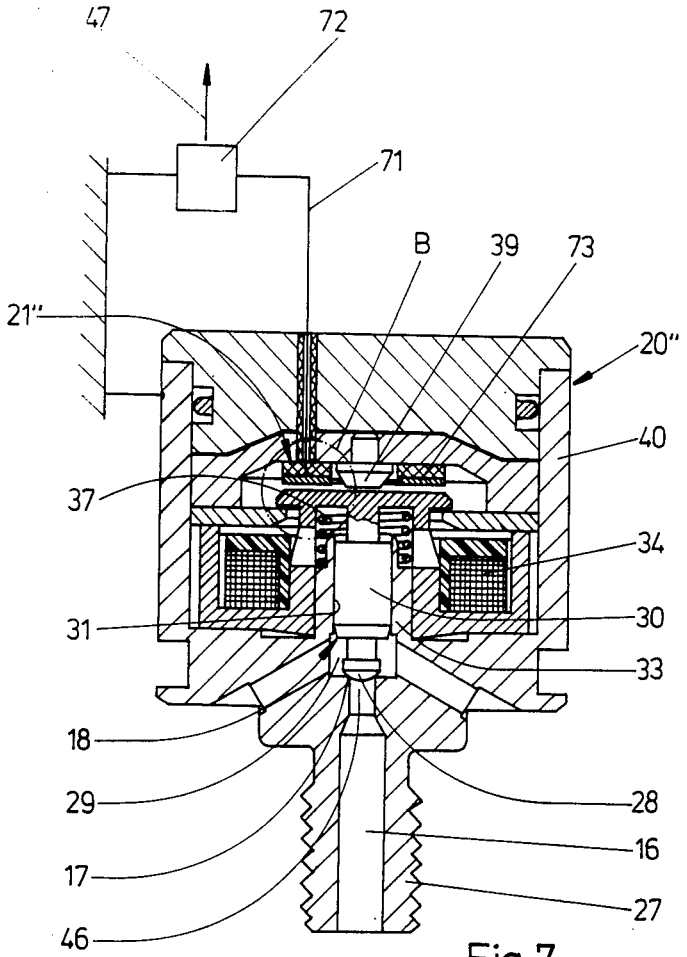
FIG. 7 is a longitudinal section taken through the 2/2-way magnetic valve of the fuel injection apparatus of FIG. 1 in a third exemplary embodiment, on a larger scale.
Figure 8:
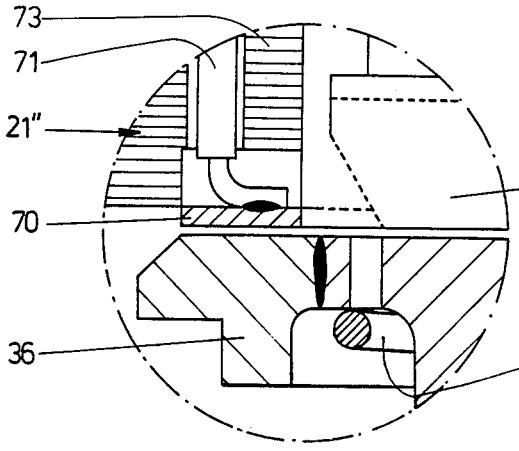
FIG. 8 is an enlargement of the detail marked B in FIG. 7.

The valve 20'' shown in FIG. 7 in longitudinal section in another exemplary embodiment is again embodied as a 2/2-way magnetic valve and is identical to the valves 20 and 20' described above, except for the switching position transducer 21'', so identical elements are again identified by the same reference numerals. Referring to FIG. 8 for a detail view, the stop 39 for limiting the stroke of the valve member 18 is surrounded by an annular metal disc 70 disposed in an insulated manner in the valve housing 40. Via an electric supply lead 71 passed in an insulated manner through the valve housing 40, this annular disc 70 is connected to one terminal of a measuring instrument 72, the other terminal of which rests on the valve housing 40. Together with the armature plate 36 connected to the valve member 18, the annular disc 70 forms a ring capacitor, the capacitance of which is proportional to the distance between the annular disc 70 and the armature plate 36. As the distance between the armature plate 36 and the stop 39 varies, the capacitance of the ring capcitor varies as well and is thus directly dependent on the stroke of the valve member 18. By means of known evaluating methods (such as carrier frequency, LC oscillation circuit, frequency discriminators, charge amplifiers, etc.), the measuring instrument 72 detects the change in capacitance of the ring capacitor and emits a corresponding voltage signal 47, which is a measure of the instantaneous switching position of the valve, to the control unit 22, which evaluates this voltage signal in the same manner as described above. The design of the switching position transducer 21'' as a ring capacitor is shown on a larger scale in FIG. 8, in which it is also clearly shown that for securing the annular disc 70 in an insulated manner, this disc is mounted on its end face on an annular holder 73, which is secured in turn in the valve housing 40.

The course of the stroke of the valve member 18 of the valve 20'' when electric current is applied to the magnet coil 34, or interrupted, corresponds exactly to the upper diagram of FIG. 3. When the magnet coil 34 is lacking current, the valve member 18 is in the open position and rests on the stop 39, via the armature plate 36. The capacitance of the ring capacitor is at its maximum and serves as a reference capacitance for the measuring instrument 72. When current is supplied to the magnet coil 34, the armature plate 36 begins to lift from the stop 39 at point BSP, after an initial switching-on time lag. As the valve member 18 moves increasingly toward the valve seat 17, the distance between the armature plate 36 and the annular disc 70 increases, causing a decrease in the capacitance of the ring capacitor. At point BEP, the valve member 18 is seated on the valve seat 17, and the valve 20'' is closed. The capacitance of the ring capacitor has reached a minimum, and the change in capacitance detected by the measuring instrument 72 has reached a maximum. The maximum change in capacitance is a measure for the attainment of the closing position of the valve 20''. After the supply of current is swithced off, and after an initial switching-off time lag, the valve member 18 beings at point BÖP to lift from the valve seat 17 and to move away from the valve seat 17 under the influence of the compression spring 37. The distance between the armature plate 36 and the annular disc 70 decreases, and the capacitance of the ring capacitor increases. At point EEP, the armature plate 36 strikes the stop 39; the ring capacitor has once again attained its maximum capacitance. The change in capacitance detected by the measuring instrument 72 has again reached a maximum, and this signals the attainment of the terminal position of the valve member 18 and hence the open position of the valve. Since the valve 20", like the other two valves 20 and 20', is located as a shutoff valve in the connecting line 16 from the pump work chamber 6 to the suction chamber 8, with the closure of the valve 20" the fuel metering phase is initiated, and with the opening of the valve 20" the fuel metering phase is terminated. The maximum change in capacitance always represents a signal for the end of movement of the valve member 18. The first end-of-movement signal thus characterizes the closing state, and the second end-of-movement signal characterizes the opening state of the valve 20". The beginning of the change in capacitance characterized the beginning of movement on the part of the valve member 18. The control unit 22 in turn detects the time interval between a first end-of-movement signal and an ensuing beginning-of-movement signal as an actual value for the control time of the valve 20" that is effective for metering. During this control time, the valve 20" is kept in its closing state. As already noted in connection with FIG. 1, here again the first phase of movement of the valve member 18 between the points BSP and BEP, that is, the switching-on travel time and the second phase of movement between the points BOP and EEP, the so-called switching-off travel time, can also, after suitable weighting with a first and second factor, be added to the control time that is effective for metering.

The valve 20" and the switching position transducer 21" can also be used as a so-called metering valve, which with the elimination of the connecting line 16 would then be disposed in the supply conduit 7. In the identical stroke course of hte valve member 18 as shown in the first diagram of FIG. 3, the first end-of-movement signal (at point BEP) then characterizes the opening state, and the second end-of-movement signal (at point EEP) characterizes the closing state of the valve 20". The control time of the valve 20" that is effective for metering, between the first end-of-movment signal (at point BEP) and the ensuing beginning-of-movement signal (at point BÖP) keeps the valve 20" in its opening state during the intake stroke of the pump piston 3.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection apparatus for internal combustion engines comprising a fuel injection pump provided with a pump piston operative within a pump cylinder and having a pump work chamber defined thereby, in particular a fuel injection pump of the distributor injection pump type, said pump further having a valve disposed in a connecting line between the pump work chamber and a low-pressure fuel supply chamber, the valve being electrically controllable between two switching positions occurring at selectable switching times, said switching allowing determination of a quantity of fuel to be injected per pump piston supply stroke, said pump further having a control unit for switching the valve in accordance with engine operating parameters and a switching position transducer connected thereto, said switching positon transducer being arranged to detect an instantaneous switching position of said valve and to deliver two electrical signals to the control unit, a first of said indicating a beginning of movement state of a valve member of the valve and comprising a beginning-of-movement signal, a second of said signals indicating an end of movement state of the valve member and comprising an end-of-movement signal, the control unit being adapted to detect a first time interval occurring between a first said end-of-movement signal and an ensuing said beginning-of-movement signal, said time interval comprising a control time of the valve effective for metering a quantity of fuel actually attaining injection, whereby correction of the valve switching and compensation for any undesired variations in switching time due to wear, drift or malfunction may be realized.

2. An apparatus as defined by claim 1, further wherein the control unit measures a second time interval occurring between initiation of a second said beginning-of-movement signal and an ensuing end-of-movement signal, said second time interval comprising a second value representing a second movement phase, which value is multiplied by a second factor and added to said control time effective for metering to derive the quantity of fuel actually attaining injection.

3. An apparatus as defined by claim 1, further wherein the control unit measures a third time interval occurring between initiation of an initial said beginning-of-movement signal and an ensuing first said end-of-movement signal, said third time interval comprising a first value representing a first movement phase, which value is multiplied by a first factor and added to said control time effective for metering to derive the quantity of fuel actually attaining injection.

4. An apparatus as defined in claim 2, further wherein the control unit measures a third time interval occurring between initiation of an initial said beginning-of-movement signal and an ensuing first said end-of-movement signal, said third time interval comprising a first value representing a first movement phase, which value is multiplied by a first factor and added to said control time effective for metering to derive the quantity of fuel actually attaining injection.

5. An apparatus as defined by claim 1, further wherein the first end-of-movement signal represents a closing state of the valve and the second end-of-movement signal represents an opening state of the valve, and the valve is triggered so as to provide that the control time that is effective for metering retains the valve in said closing state during a pumping stroke of said pump piston.

6. An apparatus as defined by claim 2, further wherein the first end-of-movement signal represents a closing state of the valve and the second end-of-movement signal represents an opening state of the valve, and the valve is triggered so as to provide that the control time that is effective for metering retains the valve in said closing state during a pumping stroke of said pump piston.

7. An apparatus as defined by claim 3, further wherein the first end-of-movement signal represents a closing state of the valve and the second end-of-movement signal represents an opening state of the valve, and the valve is triggered so as to provide that the control time that is effective for metering retains the valve in said closing state during a pumping stroke of said pump piston.

8. An apparatus as defined by claim 4, further wherein the first end-of-movement signal represents a closing state of the valve and the second end-of-movement signal represents an opening state of the valve, and the valve is triggered so as to provide that the control time that is effective for metering retains the valve in said closing state during a pumping stroke of said pump piston.

9. An apparatus as defined by claim 1, further wherein the first end-of-movement signal represents an opening state of the valve and the second end-of-movement signal represents a closing state of the valve and the valve is triggered so as to provide that the control time that is effective for metering retains the valve in said opening state during a pumping stroke of said pump piston.

10. An apparatus as defined by claim 2, further wherein the first end-of-movement signal represents an opening state of the valve and the second end-of-movement signal represents a closing state of the valve and the valve is triggered so as to provide that the control time that is effective for metering retains the valve in said opening state during a pumping stroke of said pump piston.

11. An apparatus as defined by claim 3, further wherein the first end-of-movement signal represents an opening state of the valve and the second end-of-movement signal represents a closing state of the valve and the valve is triggered so as to provide that the control time that is effective for metering retains the valve in said opening state during a pumping stroke of said pump piston.

12. An apparatus as defined by claim 4, further wherein the first end-of-movement signal represents an opening state of the valve and the second end-of-movement signal represents a closing state of the valve and the valve is triggered so as to provide that the control time that is effective for metering retains the valve in said opening state during a pumping stroke of said pump piston.

13. An apparatus as defined by claim 1, further wherein the valve is provided with a metal valve housing having a valve seat disposed to surround a flow opening and is further provided with a valve member adapted to cooperate with said valve seat, said valve member being axially displaceable and guided in a bore in the valve housing and further being actuatable so as to block and unblock said flow opening by an electrically-operated switching means, said valve member being electrically insulated with respect to the valve housing and being connected to one pole of a voltage measuring means, the opposite pole of said voltage measuring means being connected via an electrical lead to the valve housing and a stop means adapted to limit a stroke of the valve member.

14. An apparatus as defined by claim 13, further wherein the stop means is comprised of conductive plastic material and is electrically conductively connected to the valve housing.

15. An apparatus as defined by claim 13, further wherein the valve is provided with a metal valve housing having a valve seat disposed to surround a flow opening and is further provided with a valve member adapted to cooperate with said valve seat, said valve member being axially displaceable and guided in a bore in the valve housing and further being actuatable so as to block and unblock said flow opening by an electrically-operated switch means, a piezo disc comprised of a piezoelectric ceramic material being secured to a stop means adapted to limit a stroke of the valve member, and stop means being secured in the valve housing, said piezo disc being provided with opposite sides to each of which is attached a metal electrode being connected further to a voltage measuring means.

16. An apparatus as defined by claim 15, further wherein one of said metal electrodes is electrically conductively connected to the stop means and the other of said metal electrodes is electrically conductively connected to a plug contact that is insulated with respect to the stop means and the valve housing, and the valve housing is connected to one pole of the voltage measuring means and the plug contact is connected to the other pole thereof.

17. An apparatus as defined by claim 16, further wherein the stop means comprises a bolt secured in the valve housing and provided with an axial blind bore having an internal thread, said blind bore further having a radially extending bore bottom against which said piezo disc rests upon one of said electrodes, said piezo disc being secured thereon via an annular pressing ring by means of a hollow-bodied locking screw screwed into the blind bore, and said plug contact connected to the other electrode is adapted to pass through means defining an opening in the annular pressing ring so as to extend axially within the locking screw.

18. An apparatus as defined by claim 17, further wherein a disc-like contact ring connected to the plug contact is provided between an end face of the presssing ring and the electrode of said piezo disc opposed to it, and the pressing ring, the contact ring and the plug contact form a structural unit.

19. An apparatus as defined by claim 17, further wherein said piezo disc is disposed at one extremity of said bolt.

20. An apparatus as defined by claim 13, further wherein the valve member has a metal disc disposed on its end remote from the valve seat, said valve further including a stop for limiting a stroke of the valve member, said stop means being surrounded by a metal annular disc disposed in an electrically insulated manner with respect to said valve housing, and the piezo disc and the metal annular disc together form a ring capacitor, said ring capacitor being connected to a means for measuring change in capacitance of the ring capacitor during the stroke of the valve member.

21. An apparatus as defined by claim 20, further wherein the annular disc is conductively connected with an electrical lead to said capacitance measuring means and said lead is insulated from the valve housing.

22. An apparatus as defined by claim 1, further wherein the electrically controllable valve is a 2/2-way magnetic valve.

23. An apparatus as defined by claim 20, further wherein the piezo disc of the ring capacitor comprises an armature plate of the electromagnet, to which the valve member is secured.

24. An apparatus as defined by claim 22, further wherein the piezo disc of the ring capacitor comprises an armature plate of the electromagnet, to which the valve member is secured.

* * * * *